US005324884A

United States Patent [19]

Honda et al.

[11] Patent Number: 5,324,884

[45] Date of Patent: Jun. 28, 1994

[54] DEVELOPING DEVICE HAVING FIRST AND SECOND TONER SUPPLY MEANS WITH AN ELECTRIC FIELD GENERATED THEREBETWEEN

[75] Inventors: Toshiro Honda, Tokyo; Koji Imamiya, Kawasaki; Tamiko Nakajo, Yokohama; Shigenobu Osawa, Kawasaki, all of Japan

[73] Assignee: Kabushiki Kaisha Toshiba, Kawasaki, Japan

[21] Appl. No.: 980,693

[22] Filed: Nov. 24, 1992

[30] Foreign Application Priority Data

Jan. 16, 1992 [JP] Japan ..... 4-005992

[51] Int. Cl.[5] ..... G03G 15/08

[52] U.S. Cl. ..... 118/651; 355/259

[58] Field of Search ..... 118/656-658, 118/647, 651; 355/259, 265, 251-253

[56] References Cited

U.S. PATENT DOCUMENTS

| | | | |
|---|---|---|---|
| 4,508,052 | 4/1985 | Kohyama | 118/651 |
| 4,686,934 | 8/1987 | Kohyama | 118/651 |
| 4,809,034 | 2/1989 | Murasaki et al. | 118/652 X |
| 4,912,513 | 3/1990 | Oka et al. | 355/253 |
| 5,063,875 | 11/1991 | Folkins et al. | 118/651 |
| 5,095,850 | 3/1992 | Komuro | 118/657 |
| 5,183,964 | 2/1993 | Stelter et al. | 118/653 |

*Primary Examiner*—R. L. Moses

*Attorney, Agent, or Firm*—Foley & Lardner

[57] ABSTRACT

A developing device includes a storage portion for storing toner, a developing roller facing and supplying the toner to an image carrier, and a rotatable supply roller for supplying the toner in the storage portion to the developing roller. A thin layer of the toner supplied from the supply roller is formed on the circumferential surface of the developing roller by a blade. Different bias potentials are individually applied to the supply roller and the developing roller by means of first and second power source so that the bias potential of the supply roller is higher than that of the developing roller with respect to the polarity of the toner.

8 Claims, 6 Drawing Sheets

DEVELOPING DEVICE HAVING FIRST AND SECOND TONER SUPPLY MEANS WITH AN ELECTRIC FIELD GENERATED THEREBETWEEN

BACKGROUND OF THE INVENTION

1. Field of the Invention

The present invention relates to a developing device for visualizing an electrostatic latent image in an electrophotographic apparatus or electrostatic recording apparatus.

2. Description of the Related Art

Electrophotography, electrostatic recording, and other image forming systems are applied to modern image forming apparatuses. Among these systems is a prevailing developing system for visualizing an electrostatic latent image. This system is based on the two-component developing method in which the latent image is electrostatically developed by means of a developing agent, a mixture of a toner as a coloring material and a carrier as a magnetic material.

The two-component developing method, however, is subject to a drawback such that it requires control of the mixture ratio between the toner and the carrier, as well as use of a large-sized complicated developing device. Therefore, some of modern small-sized copying machines and printers use the one-component developing method which requires no carrier. In particular, the nonmagnetic one-component developing method, in which no magnets are arranged in the developing device, has some advantages, such as the reduction of the size and weight of the developing device, low cost, ease of conversion to color developing, etc. Many research reports recently been made on this method.

In a conventional developing device of this type, the toner (developing .agent) stored in a hopper is delivered to a developing roller by means of a toner supply roller, which is in contact with the developing roller and rotatable in the same direction therewith. Subsequently, a thin layer of the toner is formed on the developing roller by means of a thin layer forming member, which is in linear contact with the developing roller under uniform pressure, and the toner layer is brought close to or into contact with an image carrier. By doing this, an electrostatic latent image on the image carrier is visualized.

In reproducing a continuous image, such as an entirely solid black image, which requires high density throughout a wide area, by means of the conventional developing device described above, however, the toner supply to the developing roller cannot cover the toner consumption, so that the thin toner layer cannot be formed satisfactorily. Thus, there has been a fatal problem on the quality of a solid image, lower density at the trailing end portion of the image compared with the leading end portion thereof.

SUMMARY OF THE INVENTION

The present invention has been developed in consideration of these circumstances, and its object is to provide a developing device, which can develop an entire solid image with uniform density, and insure stable, high-quality development without lowered image density even in the case of continuous image formation.

In order to achieve these above objects, a developing device according to the present invention comprises: means for storing the one-component developing agent; first supply means facing the image carrier, for supplying the developing agent to the latent image on the image carrier; second supply means contacting the first supply means, for supplying the developing agent in the storing means to the first supply means; means for forming a thin layer of the one-component developing agent, which is supplied from the second supply means, on a surface of the first supply means; and means for applying different bias potentials individually to the first and second supply means so that the bias potential of the second supply means is higher than that of the first supply means with respect to the polarity of the developing agent, the difference (VS−VD) between the bias potential VS of the second supply means and the bias potential VD of the first supply means being set within the range of $0<(VS-VD)<200V$.

According to the developing device described above, an electric field is generated between the first and second supply means in a direction such that the developing agent is guided to the first supply means by applying the different bias voltages individually to the first and second supply means by means of the applying means. Thus, a sufficient amount of the developing agent can be fed from the second supply means to the first supply means. Even in developing a continuous image, such as an entirely solid black image, which requires high density throughout a wide area, therefore, a high-quality image of uniform density can be steadily developed without involving a short supply of the developing agent.

According to the developing device of the present invention, moreover, the first and second supply means have their respective volume resistivities ranging from $10^4$ to $10^8$ Ω·cm. Thus, the leakage of the bias voltage can be prevented to ensure stable continuous supply of the developing agent, so that high-quality developing can be satisfactorily effected with reliability.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention and, together with the general description given above and the detailed description of the preferred embodiment given below, serve to explain the principles of the invention.

FIGS. 1 to 10 show an image forming apparatus provided with a developing device according to an embodiment of the present invention, in which:

FIG. 1 is a sectional view of the image forming apparatus;

FIG. 2 is a sectional view of the developing device;

FIG. 3 is a cutaway perspective view of a developing roller of the developing device;

FIG. 4 shows characteristic curves representing the correlations between the electrical resistance value and surface potential of the developing roller and the image quality;

FIG. 5 is a perspective view of a blade of the developing device;

FIG. 6 is a sectional view showing part of the blade of the developing device;

FIG. 7 shows a characteristic curve representing the correlations between the toner delivery of the developing roller, toner supply bias potential, and the image quality;

FIG. 8 is a schematic view showing a measuring device for measuring the toner delivery of the developing device;

FIG. 9 shows characteristic curves representing the correlations between the electrical resistance value of a toner supply roller, bias potential difference, and the image quality; and FIG. 10 shows characteristic curves representing the correlations between the electrical resistance value of the toner supply roller, leakage current value, and the image quality.

DETAILED DESCRIPTION OF THE PREFERRED EMBODIMENTS

An embodiment of the present invention will now be described in detail with reference to the accompanying drawings.

Figure 1:
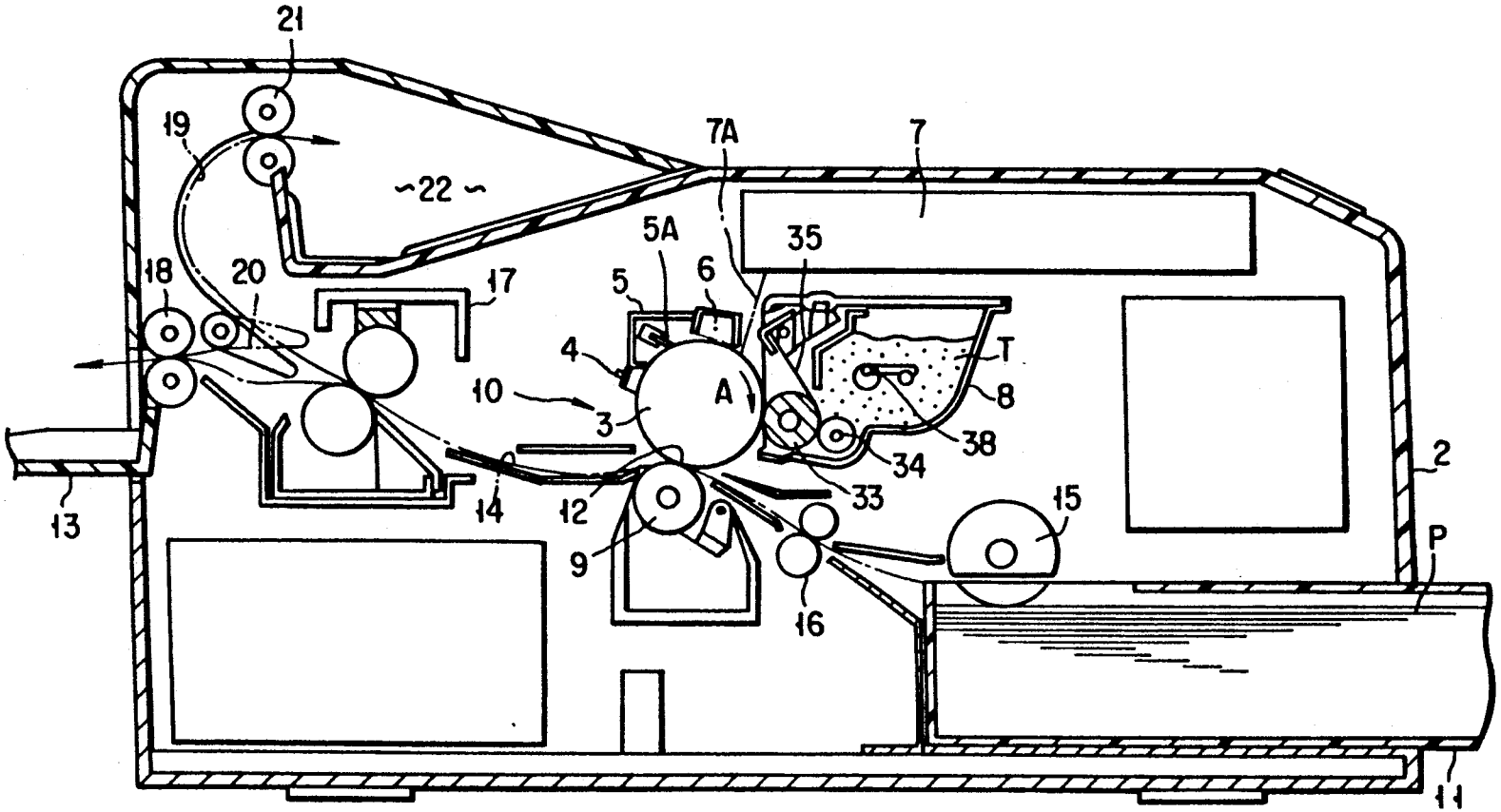

FIG. 1 shows an image forming apparatus of a cleanerless-process type which incorporates a developing device according to an embodiment of the present invention.

As shown in FIG. 1, the image forming apparatus comprises a housing 2 and a photoconductive drum 3 for use as an image carrier. The drum 3 is located substantially in the center of the housing 2 so as to be rotatable in the direction of arrow A. The drum 3, which is formed of a photoconductive material based on an organic photoconductor (OPC), has a diameter such that its circumferential surface is shorter than an image to be recorded thereon.

The photoreceptor drum 3 is surrounded by a red LED 4 for use as a de-electrifier having the function mentioned later, an unpatterning unit 5 for unpatterning residual toner, a scorotron charger 6, a laser unit 7 for use as electrostatic latent image forming means, a developing device 8 doubling as a cleaning unit, and a transfer roller 9, which are successively arranged in the rotating direction of the drum. These components constitute image forming means 10 for forming a toner image TI as a developer image on the circumferential surface of the drum 3.

A paper transportation path 14 is defined in the housing 2. It is used to guide a paper sheet P as a transfer medium, taken out of a paper cassette 11 attached to one side of the housing 2, to a receiving tray 13 on the other side of the housing 2 through an image transfer section 12 between the photoconductive drum 3 and the transfer roller 9.

An aligning roller pair 16 is arranged on the upper-course side of the paper transportation path 14 with respect to the image transfer section 12. The roller pair 16 aligns the leading end of the paper sheet P, taken out of the paper cassette 11 by means of a paper supply roller 15, and then timely feeds the sheet into the transfer section 12. A fixing unit 17 and a discharge roller pair 18 are arranged on the lower-course side of the transfer section 12. The fixing unit 17 fixes the toner image TI transferred to the paper sheet P. The discharge roller pair 18 serves to discharge the fixed sheet P onto the receiving tray 13.

Located between the fixing unit 17 and the discharge roller pair 18 is a gate 20 which guides the paper sheet P from the unit 17 to a reverse transportation path 19, if necessary. The sheet P introduced into the path 19 is delivered to a paper discharge section 22, which is formed of a recess in the top face of the housing 2, with its image forming surface downward.

The following is a description of an outline of the image forming operation of the image forming apparatus constructed in this manner.

First, the photoconductive drum 3 is rotated, and the circumferential surface of the drum 3 is negatively charged in a substantially uniform manner by means of the scorotron charger 6. Then, a laser beam 7*a* from the laser unit 7 is applied onto this charged region to expose it in accordance with image information to be recorded. As a result, an electrostatic latent image is formed on the surface of the drum 3. As the drum 3 rotates, the latent image faces the developing device 8.

Figure 2:
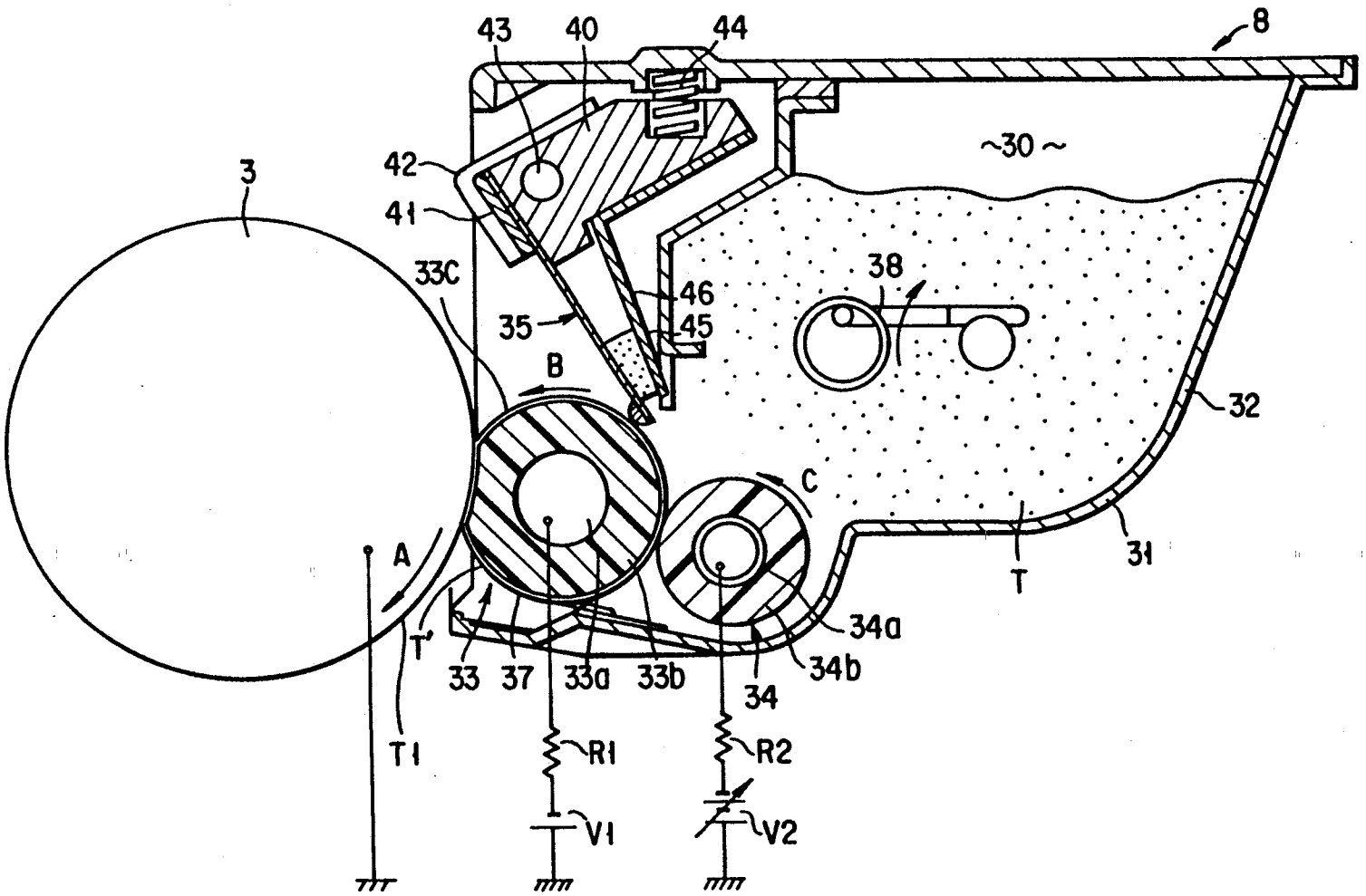

Thereupon, a developing roller 33, which has a layer of a frictionally chargeable toner T for use as a so-called one-component developing agent formed thereon, starts to rotate, whereby the toner T is caused to adhere to the electrostatic latent image on the photoconductive drum 3, thus forming the toner image TI (see FIG. 2). In this case, the toner T adheres to the exposed portion of the circumferential surface of the drum 3 so that the toner image is subjected the so-called reversal development. The developed toner image TI is transported to the transfer section 12 which faces the transfer roller 9.

Meanwhile, the paper sheet P, taken out from the paper cassette 11 by means of the paper supply roller 15, is delivered to the transfer section 12 by means of the aligning roller pair 16 in synchronism with the rotation of the photoconductive drum 3. The back of the delivered sheet P is charged to the positive polarity by means of the transfer roller 9. Thus, the toner image TI on the surface of the drum 3 is electrostatically attracted and transferred to the sheet P.

According to this contact-type transfer, stable transfer properties can be enjoyed even at high humidity, so that the amount of residual developing agent can be reduced to lighten the cleaning load. Also, paper dust in the paper sheet P can be removed and prevented from getting mixed in the toner T.

After the transfer process, the paper sheet P is delivered to the fixing unit 17, whereupon the toner T is melted and fixed to the sheet P by means of heat under pressure, and the sheet P is then discharged.

On the surface of the photoconductive drum 3 remains a small amount of residual toner T, having failed to be transferred, or positive and negative residual electrostatic latent images, even after the transfer of the toner T. Accordingly, the negative latent image is first erased by means of the red LED 4, and the residual toner is stirred up and unpatterned by the unpatterning unit 5, whereupon the charging stage is restarted.

After the charging process, the outer circumferential surface of the photoconductive drum 3 is exposed to form an electrostatic latent image thereon by means of the laser unit 7, and reaches again (for a second cycle) a developing/cleaning position which faces the developing device 8. In the electrostatic latent image formed in the second cycle, latent images at an exposed portion (image portion to which the toner is to adhere) and an unexposed portion (no-image portion) are considerably reduced by roller transfer, and the residual toner is scattered substantially uniformly and thoroughly in advance, so that unevenness of exposure cannot be caused. Also in the second developing cycle, therefore, the residual potential on the exposed outer circumferential surface of the drum 3 is uniform, so that a uniform toner image can be obtained.

In the developing device 8, the developing roller 33 touches the photoconductive drum 3 with a predetermined contact width (nip width) for higher cleaning capability. Also, a developing bias, which is adjusted to a value intermediate between the residual potential at the exposed portion and the potential at the unexposed portion, is applied to the developing roller 33. Accordingly, the toner T is newly supplied from the developing roller 33 and adheres to the exposed portion of the drum 3. At the same time, the toner T having so far been adhering to the unexposed portion is attracted to the developing device 8 and recovered, since an attraction force caused by the developing bias is greater than the adhesive force of the toner T on the unexposed portion of the drum 3. Thus, developing the exposed portion and cleaning the unexposed portion are carried out simultaneously.

The construction of the developing device 8 will now be described in detail.

As shown in FIG. 2, the developing device 8 comprises a casing 32 which includes a toner hopper 31 as its integral part, and a toner storage section 30 is defined in the hopper 31. The casing 32 has an opening which faces the photoconductive drum 3, and the developing roller 33, which doubles as a cleaning roller, is located in the vicinity of the opening. The roller 33 is elastically in contact with the drum 3 so that the predetermined nip width is produced by deformation. It is rotatable in the direction (indicated by arrow B) opposite to the rotating direction of the drum 3.

The developing roller 33 is connected, through a protective resistor R1, with a developing bias power source V1 for applying the developing bias to the roller 33.

At the bottom of the toner storage section 30, a toner supply roller 34, for use as developing agent supply means for supplying the toner T to the developing roller 33, is located behind the roller 33. The roller 34, which is in rolling contact with the developing roller 33, is rotated in the same direction (indicated by arrow C) as the roller 33. Also, the supply roller 34 is connected, through a protective resistor R2, with a toner supply bias power source V2 for applying a predetermined bias voltage to the roller 34. The roller 34 doubles as a recovery roller for recovering a residual toner T' left on the developing roller 33 after the developing process.

In the casing 32, a blade 35 for use as developing agent layer forming means is located over the developing roller 33. The blade 35 regulates the toner delivery by means of the developing roller 33 so that a thin layer of the toner T is formed on the surface of the roller 33. A recovery blade 37 is arranged in contact with the underside of the roller 33. A mixer 38 for stirring the toner T is provided in the toner storage section 30.

In the developing device 8 which uses the non-magnetic one-component developing system, the developing roller 33 is expected to have electrical conductivity and elasticity. The simplest arrangement of the developing roller to fulfill this requirement is a combination of a metal shaft and an electrically conductive rubber roller. In the present embodiment, moreover, the toner T is pressed against the developing roller 33 as it is transported, so that the surface of the roller 33 is smooth enough to permit it.

Figure 3:
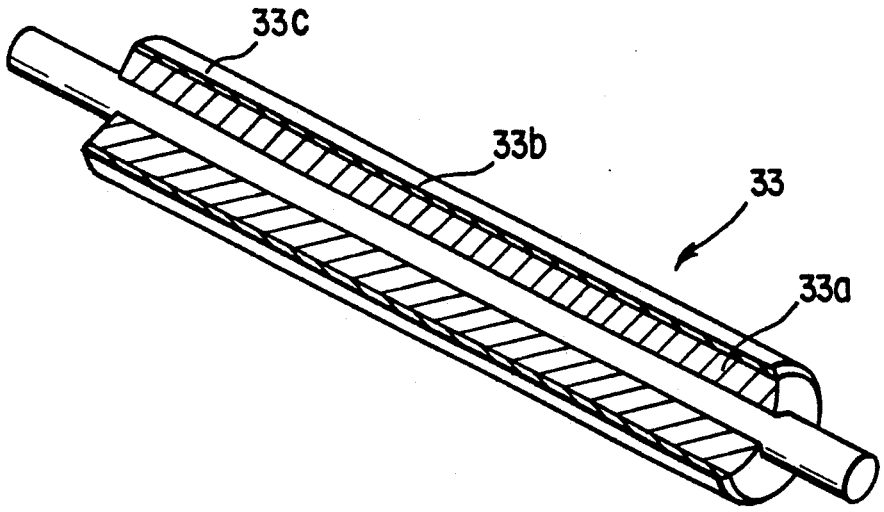

More specifically, as shown in FIGS. 2 and 3, the developing roller 33 is composed of a metal shaft 33*a*, an elastic layer 33*b* surrounding it, and a conductive surface layer 33*c* thereon, and is in the form of an elastic roller as a whole.

The elastic layer 33*b* may or may not have electrical conductivity. In consideration of the possibility of the conductive surface layer 33*c* being separated or damaged, however, the elastic layer 33*b* should preferably be electrically conductive. Further, the layer 33*b* is pressed against the blade 35 and the photoconductive drum 3. If the hardness of the rubber of the layer 33*b* is high, therefore, a great lead is needed to obtain the predetermined nip width, and therefore, the driving torque of the developing device must be increased.

Moreover, the permanent strain (%, provided by JIS K6301) of the elastic layer 33*b* raises a problem when the developing roller 33 is packed or nonoperating for a long time. If the permanent strain of the layer 33*b* exceeds 10% , the resulting image is subject to unevenness corresponding to the cycle of rotation of the developing roller. Therefore, the permanent strain of the layer 33*b* should be restricted to 10% or less, preferably 5% or less. In general, the higher the rubber hardness, the lower the permanent strain is. Thus, the material of the elastic layer 33*b* should be selected in consideration of the balance between the rubber hardness and the permanent strain.

The conductive surface layer 33*c*, which is directly in contact with the toner T and the photoconductive drum 3, should be formed so that a plasticizer, vulcanizer, or process oil cannot ooze out therefrom and contaminate the toner T or drum 3. Preferably, the surface roughness of the layer 33*c* is 3 μm Rz or less. If it exceeds this value, indentation patterns of the surface are liable to appear on the resulting image.

The surface roughness of 3 μm Rz may be obtained by forming the conductive surface layer 33*c* with a sufficient thickness on the elastic layer 33*b*, and then post-working (polishing) the layer 33*c* for a predetermined outside diameter and surface roughness of the developing roller 33. Since this working entails high cost, however, the desired surface roughness should preferably be obtained without the working. To attain this, the surface roughness of the elastic layer 33*b*, the thickness of the conductive surface layer 33*c*, and the viscosity of coating must be properly selected.

More specifically, the lower the viscosity, and the higher the surface roughness of the elastic layer 33*b*, the greater the thickness of the conductive surface layer 33*c* should be. Also, the elongation of the material of the surface layer 33*c* itself is a problem. If the elongation is 50% or less, the layer 33*c* cannot follow elastic deformation of the rubber, as mentioned before, so that cracks are liable to be caused at both ends of the developing roller which are subject to great elastic deformation, in particular.

Unless the difference between the elongation (%) of the material of the elastic layer and that of the material of the conductive surface layer 33*c* is 200% or less, the layer 33*c* cannot follow up the elastic deformation of the rubber. Thus, cracks may be caused, as mentioned before, and unevenness of density is liable to be caused during each revolution of the developing roller 33. In the present embodiment, the toner T is negatively charged, so that the surface layer 33*c* is formed of a material which is susceptible to positive frictional charging and has high toner carrying capability.

Figure 4:
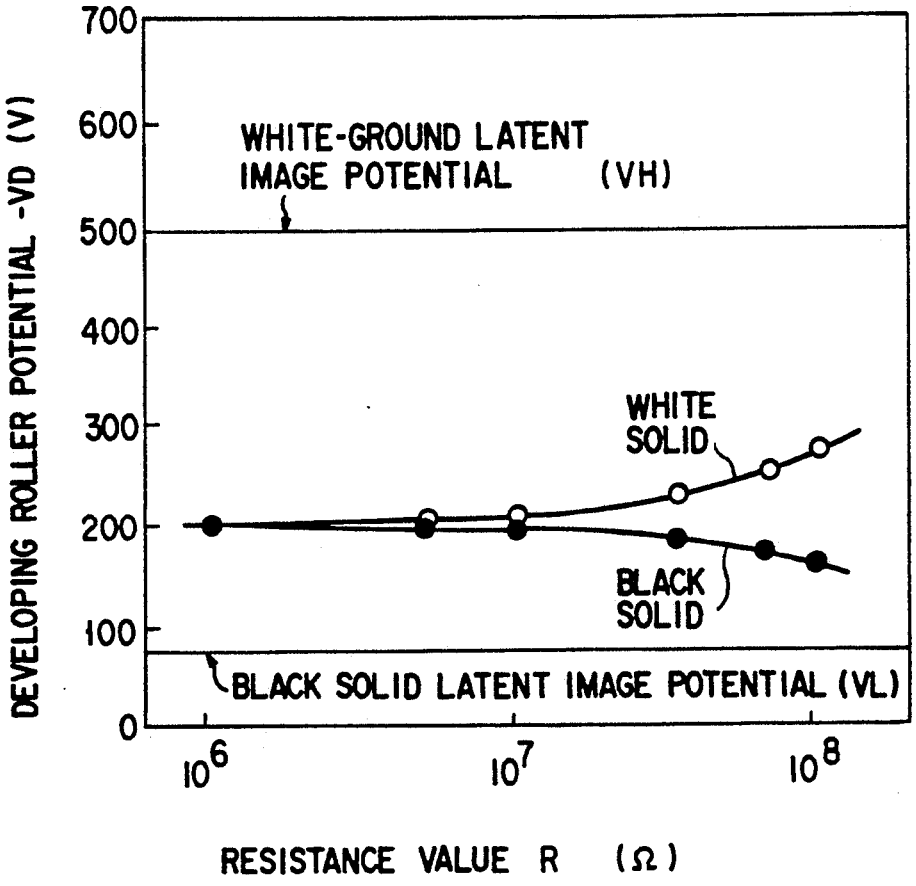

In order to identify electrical properties required of the developing roller 33, and to examine the relationship between the resulting image and the electrical resistance (volume resistivity) between the metal shaft 33*a* as a support and the surface of the conductive surface layer 33*c*, a developing test was conducted with use of the protective resistor of an optional resistance value arranged between the developing bias power source V1 and the shaft 33*a*. FIG. 4 shows the correlations between the resulting surface potential of the developing roller 33 and the image.

In this case, the voltage (VD) of the developing bias power source V1 is adjusted to −200V. If the resistance value of the protective resistor R1 is $10^7$ Ω·cm or more, during the developing process, the surface potential of the developing roller 33 assumes different values for solid white and black images, as seen from FIG. 4. A solid white image tends to approach a white-ground latent image potential (VH), and a solid black image to approach a black-ground latent image potential (VL). Thus, in an image having a large-area image portion, the difference between the black-ground latent image potential (VL) and the surface potential of the developing roller 33 is so small that the image density is low. In a fine-line image having a small-area image portion, on the other hand, the surface potential of the roller 33 approaches the white-ground latent image potential (VH), that is, the potential difference is so large that only a fuzzy image with thick outlines can be produced. This fluctuation of the surface potential of the developing roller 33 is caused by current which flows through the aforesaid resistor during the developing process.

In the solid black development, negatively charged toner particles are transferred from the developing roller 33 to the photoconductive drum 3, so that current flows from the roller 33 toward the bias power source V1. In the solid white development, the surface charge on the drum 3 is removed by means of the roller 33, so that current flows from the power source V1 toward the roller 33. Thus, these currents produce a potential difference across the protective resistor R1, thereby causing a fluctuation of the surface potential of the developing roller 33.

This tendency is marked when the resistance value of the protective resistor R1 is $10^8$ Ω·cm or more. It was confirmed that the respective resistance values of the metal shaft 33*a* and the conductive surface layer 33*c* should range from $10^4$ to $10^8$ Ω·cm, preferably from $10^4$ to $10^7$, in order to obtain a satisfactory image.

Thus, in the developing roller 33 according to the present embodiment, a conductive silicone rubber, conductive urethane rubber, or conductive polyurethane rubber with the rubber hardness (JIS-A) of 35° or less, elongation of about 250 to 500%, and electrical resistance value of $10^6$ Ω·cm or less was used for the elastic layer 33*b*, and a conductive polyurethane paint (Superlex (trademark) from Japan Miractron Co., Ltd.) with the electrical resistance value of $10^4$ to $10^5$ Ω·cm and elongation of 100 to 400% was used for the conductive surface layer 33*c*. Thereupon, the rubber hardness of the entire developing roller 33 was found to be about 30 to 50%.

The conductive surface layer 33*c* with the thickness of about 50 to 100 μm was formed on the elastic layer 33*b* with the surface roughness of 5 to 10 μm Rz by spray coating. Thereupon, the developing roller 33 with the surface roughness of 3 μm Rz was obtained. The resulting strain recovery speed and output image proved satisfactory.

In the present invention, the developing roller 33 was formed by covering the metal shaft 33*a* with the conductive silicone rubber, urethane rubber, or polyurethane rubber. However, the rubber material is not limited to these rubbers, provided it has the aforesaid properties. Although the metal shaft 33*a* was used as the support, it may be replaced with, for example, a resin shaft, provided it allows the bias voltage supply. If the bias voltage is supplied directly to the conductive surface layer 33*c* or the elastic layer 33*b*, the support need not be electrically conductive, and may be formed of an insulating material.

The toner supply roller 34 has two functions, supplying the toner T to the developing roller 33 and scraping the residual toner T from the developing roller 33 after the developing process. To attain this, the roller 34 includes a metal shaft 34*a* and an elastic layer 34*b* thereon. The layer 34*b* is formed of a soft polyurethane foam (Everlight of Bridgestone Tire Co., Ltd.) with the density of about 1.0 g/cm$^3$, elongation of 150% or more, cell number of 80 cells/inc. or more, compressive residual strain of 10% or less, and electrical resistance value of $10^4$ to $10^8$ Ω·cm. Also, the supply roller 34 was designed so that the depth of contact with the developing roller 33 was about 0.2 to 1.0 mm, the contact width was 0.5 to 4.0 mm, and its rotating speed was ½ to 1/1 (circumferential speed ratio to developing roller) of the developing roller SS with respect to the direction (indicated by arrow C) against the rotation of the roller 33.

Further, a predetermined bias voltage from the toner supply bias power source (variable) V2 is supplied to the metal shaft 34*a* the protective resistor R2, so that the toner T has good mobility.

As shown in FIG. 2, the blade 35 is held in the casing 32 by means of a first blade holder 40, a spacer 41, and a second blade holder 42. The first blade holder 40 is rockably supported by means of a shaft 43, and is continually urged to rotate in a predetermined direction by a plurality of compression springs 44 for pressurization. Thus, the blade 35 is pressed against the outer circumferential surface of the developing roller 33 by the urging force of the springs 44.

A foamed material 45 formed of Molt Prene (trademark) is pasted on the back of the blade 35. It is in engagement with a baffle plate 46 which is attached to the first blade holder 40. Thus, the material 45 restrains the blade 35 from vibrating, so that a satisfactory layer of the toner T can be formed.

Figure 5:
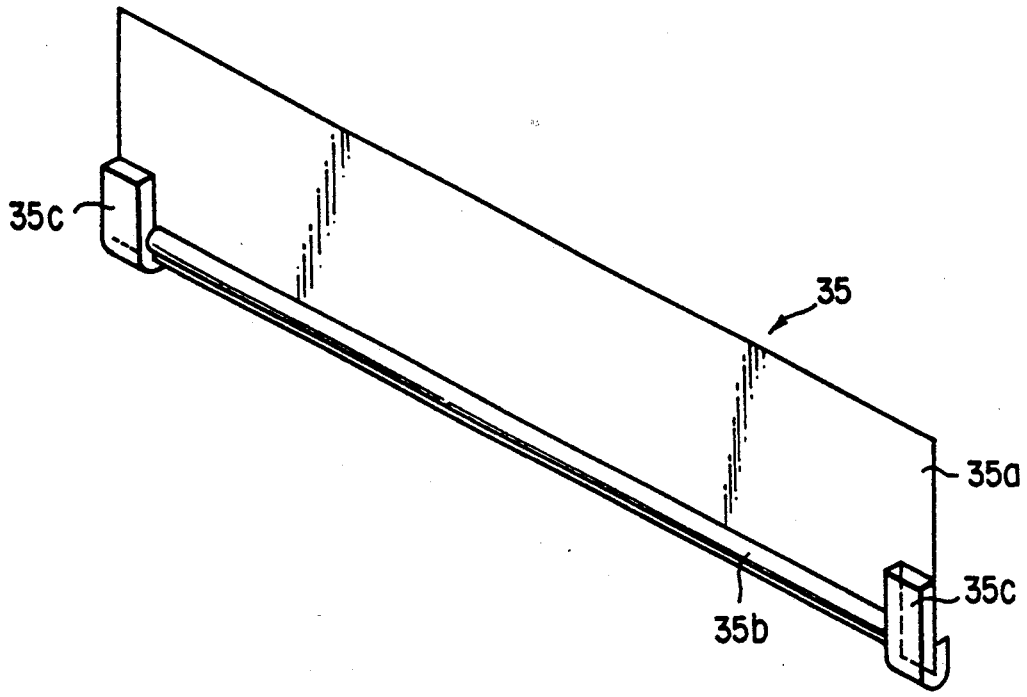

As shown in FIG. 5, the blade 35 includes a thin leaf spring member 35*a*, for use as a support member, and a tip 35*b* of resin or elastic rubber material, such as silicon rubber or urethane rubber, attached to the distal end portion of the spring member. The tip 35*b*, which extends a greater length than the image forming width along the longitudinal direction of the spring member 35*a*, is pressed against the developing roller 33 under a predetermined pressure.

Figure 6:
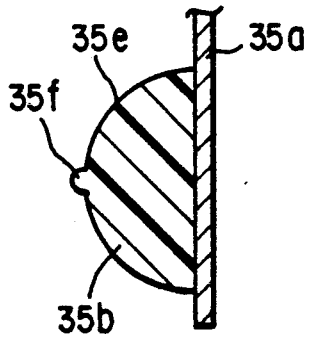

As shown in detail in the enlarged view of FIG. 6, the tip 35*b* is composed of a first projection 35*e* with a semicircular cross section and a fine second projection 35*f* formed on the surface of the distal end portion of the first projection 35*e*. The second projection 35*f* is distorted as the load is concentrated on that portion thereof at which the tip 35*b* engages the developing roller 33. Accordingly, the tip 35*b* can easily fit the roller 33, so that the toner layer can be formed satisfactorily. Thus, there is no possibility of an image failure, such as unevenness of density, attributable to a failure in toner layer formation.

According to the present embodiment, the blade 35 is positioned "against" the developing roller 33. Alternatively, however, it may be positioned "with" the roller 33.

The spring constant of compression springs 44 is lower than that of the leaf spring member 35a of the blade 35. Even if that portion of the blade 35 which engages the developing roller 33 is worn away, therefore, the force of pressure of the springs 44 hardly changes, so that a satisfactory thin layer can be maintained. The toner T which passes between the blade 35 and the roller 33 is subjected to negative frictional charging to assume the same polarity as the photoconductive drum 3. Thus, one to three layers of the toner T are formed on the surface of the developing roller 33.

Further, seal members 35c are attached individually to the opposite end portions of blade 35. Each seal member 35c has a thickness greater than the height of the tip 35b, and securely prevents the toner T from moving to its corresponding end of the blade 35.

The thin leaf spring member 35a is formed of a stainless-steel- or copper-based spring material. If the spring constant of the member 35a is high, the tip 35b, which is formed of the elastic rubber material or resin, wears quickly. Preferably, therefore, a copper-based material, such as beryllium-copper, phosphor bronze, or nickel silver, whose spring constant is lower than that of stainless steel, should be used for the spring member 35a. In the present embodiment, a phosphor bronze plate was used for this purpose in view of cost. The plate thickness used was 0.2 mm. Good results were obtained with use of the thickness ranging from 0.1 to 2.0 min.

Unless the tip 35b of the blade 35 is securely pressed against the developing roller 33, the toner layer lacks in uniformity. Accordingly, high accuracy is required of that portion of the tip 35b which touches the roller 33. An experiment indicated that the irregularity of the toner layer is negligible if the straightness of the tip 35b is 50 μm or less.

An entirely solid black image was outputted by using the developing device 8 constructed in this manner, and the correlations between the characteristics of the toner supply roller 34 and the image quality were detected.

In doing this, the surface potential (VO) of the photoconductive drum 3 was set at −500V (VH) to 70V (VL), and a developing bias potential (VD) of −200V was applied from the developing bias power source V1 to the metal shaft 33a of the developing roller 33 via the protective resistor R1. At the same time, a toner supply bias potential (VS) of −200 to −400V was applied from the toner supply bias power source (variable) V2 to the metal shaft 34a of the toner supply roller 34 via the protective resistor R2.

The developing roller 33 and the toner supply roller 34 rotate in contact with each other in the directions of the arrows of FIG. 2. In this case, the width of contact between the roller 33 and the photoreceptor drum 3 or between the rollers 33 and 34 ranges from 0.5 to 4.0 mm. The respective peripheral speeds of the drum 3 and the toner supply roller 34 are 70 mm/sec, while that of the developing roller 33 is 140 mm/sec. The developing roller 33 used has the electrical resistance value of about 107 Ω·cm.

Figure 7:
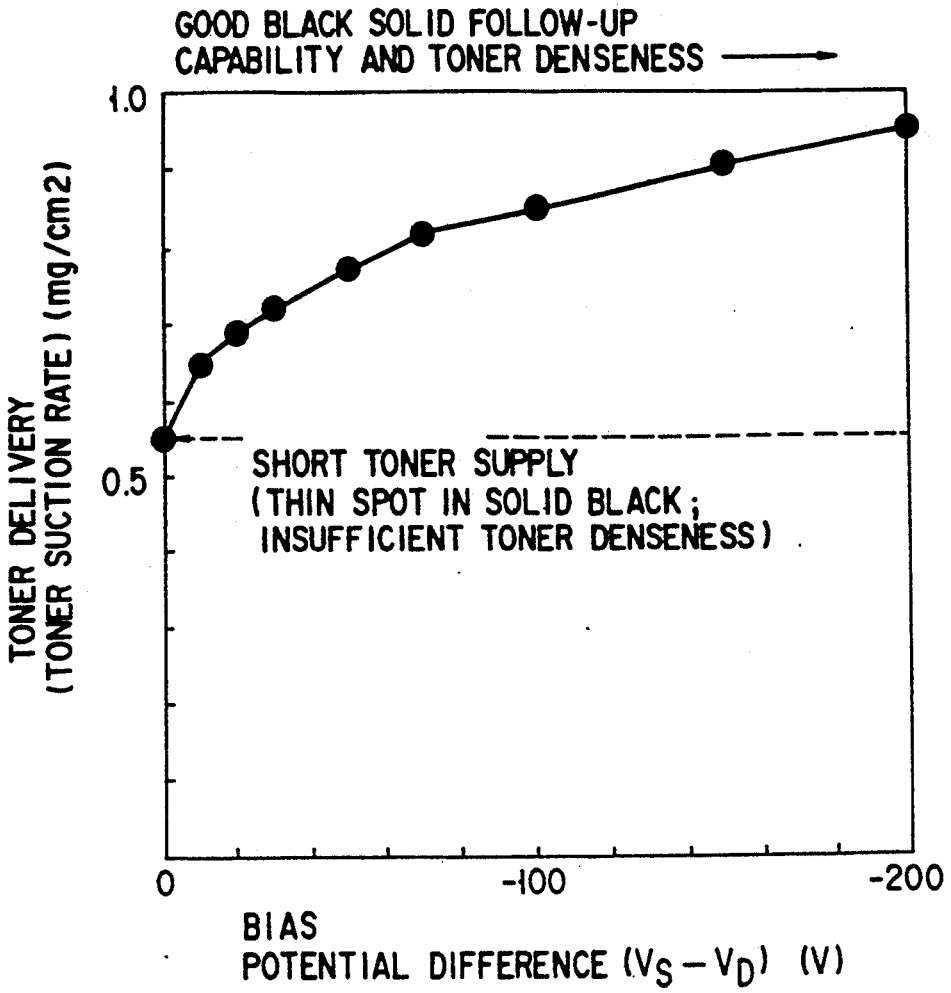

FIG. 7 shows the toner delivery on the developing roller 33 which varies as the toner supply bias potential (VS) is changed from −200 to −400V.

Figure 8:
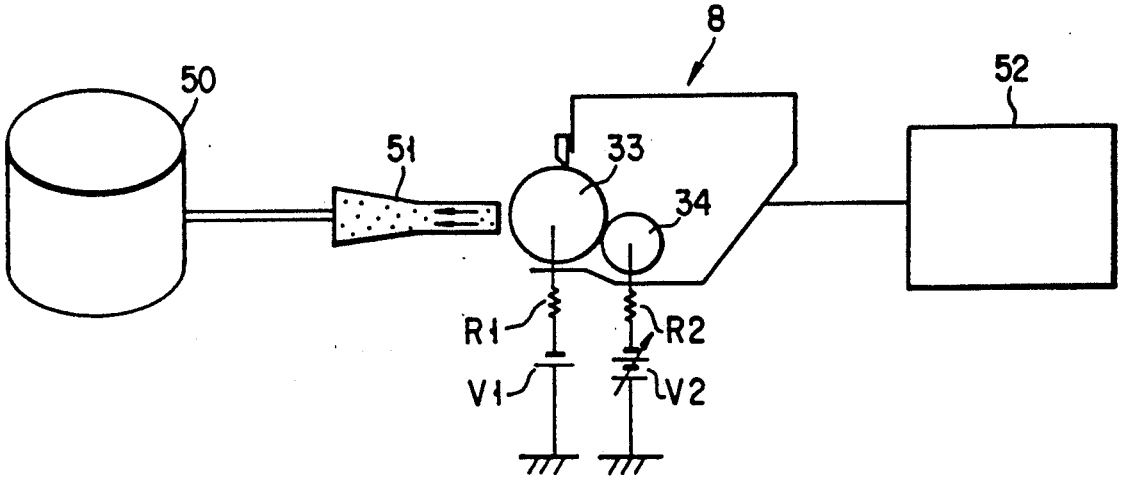

The toner delivery is an amount for the output of the solid black image obtained as follows. A suction nozzle 51 of a suction device 50 shown in FIG. 8 was located on a line perpendicular to the developing roller 33 at a suitable distance therefrom, the roller 33 was caused to make ten revolutions by means of a developing device drive motor 52, and the amount of suction (corresponding to the change of weight of the developing device 8) was measured during that time.

As seen from FIG. 7, the toner feeding capacity for the solid black image output is greater if the toner supply roller 34 is supplied with a bias voltage which generates an electric field in a direction such that the toner is guided (fed) from the toner supply roller 34 toward the developing roller 33 than if the roller 34 is supplied with the bias voltage of the same potential (−200) for the roller 33 (VS−VD=0). In other words, it was found that the toner feed for the solid black image can be increased if the bias voltage applied to the toner supply roller 34 is higher than the bias voltage applied to the developing roller 33 with respect to the polarity of the toner (VS−VD<0 for negatively charged toner; VS−VD>0 for positively charged toner).

It was confirmed that the density at the trailing end portion of a solid black image is lower in density or denseness than the leading end portion, if the bias voltage of the same potential for the developing roller 33 is applied to the toner supply roller 34 (VS−VD=0), as in the conventional case. It was found, moreover, that a satisfactory image with uniform density can be obtained if the toner delivery ranges from 0.6 to 0.8 mg/cm$^2$.

Preferably, the bias voltage difference (VS−VD) between the developing roller 33 and the toner supply roller 34 should be set within the range 0<(VS−VD)<200V. This is because the potential difference is produced between the semiconductive rollers which are in contact with each other, so that a voltage leakage is caused, considerably lowering the density of the toner layer, if a high bias voltage is applied.

In order to identify the electrical properties required of the toner supply roller 34, a developing test was conducted with the value of the electrical resistance (volume resistivity) between the respective surfaces of the metal shaft 34a and the elastic layer 34b changed without the aid of the protective resistor R2.

Figure 9:
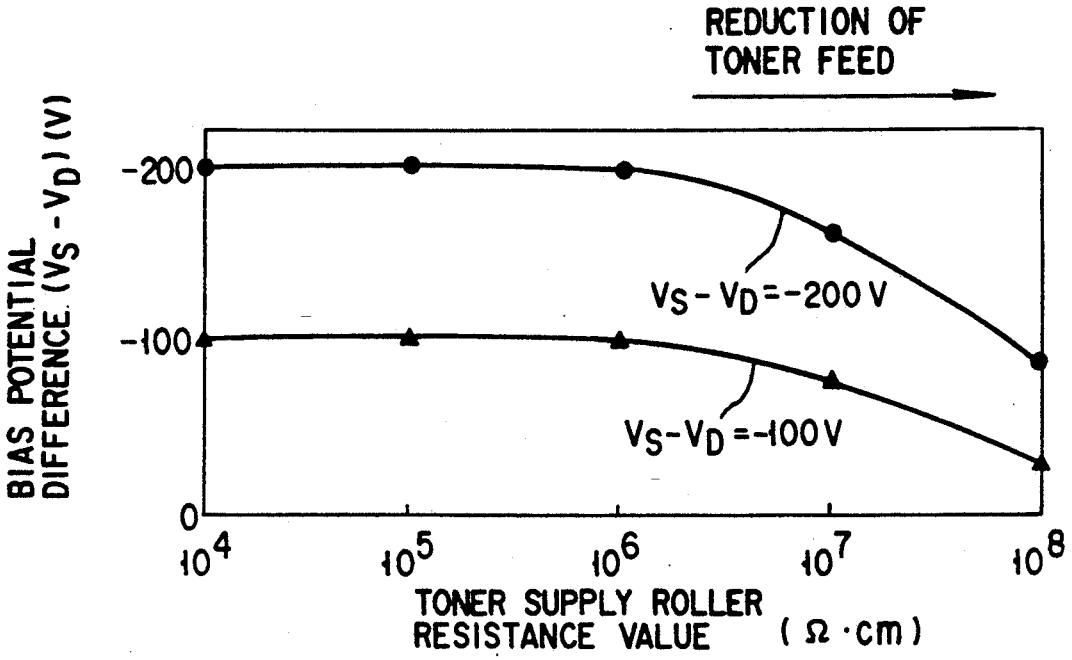
Figure 10:
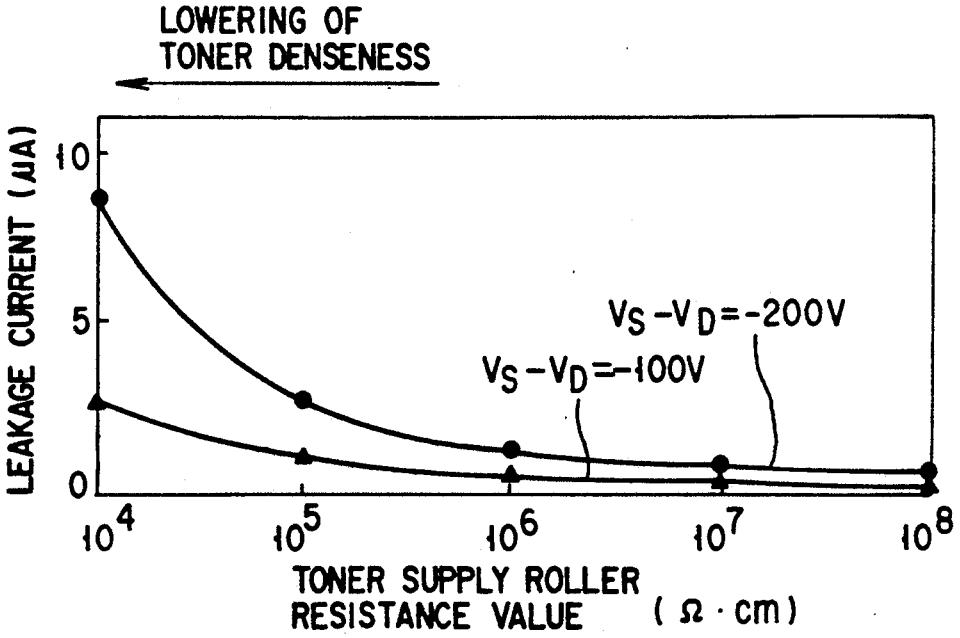

FIGS. 9 and 10 show variations of the toner supply bias potential and leakage current obtained when the electrical resistance value of the toner supply roller 34 is changed. As seen from these drawings, the value of the resistance between the surface of the elastic layer 34b and the metal shaft 34a should be adjusted to $10^5$ to $10^7$ Ω·cm. If the resistance of the roller 34 is too low at the time for the solid black image output during which toner particles with high insulation resistance momentarily cease to exist on the developing roller 33, the leakage current increases, and the density of the thin toner layer is lowered. If the resistance is too high, on the other hand, the toner supply roller 34 has its own bias, so that the surface potential of the roller 34 lowers, and the toner feed is reduced.

In the case where the protective resistor R2 of a suitable resistance value is used, the value of the electrical resistance between the tone supply roller 34 and the metal shaft 34a should be adjusted to $10^4$ to $10^8$ Ω·cm.

According to the developing device 8, as described in detail above, the different bias voltages are applied individually to the developing roller 33 and the toner supply roller 34, and the electric field for electrostatic supply of the toner T is generated on the developing-roller side. Even in developing a continuous image, such as an entirely solid black image, which requires high density throughout a wide area, therefore, a high-quality image of uniform density can be steadily developed without involving a short toner supply to the developing roller 33.

Further, the respective volume resistivities of the developing roller 33 and the toner supply roller 34 are set within the predetermined ranges, and the protective resistors R1 and R2 of the suitable resistance values are provided individually in their respective bias paths. Thus, the leakage of the bias voltage can be prevented to ensure a stable continuous supply of the developing agent, so that high-quality developing can be satisfactorily effected with reliability.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A developing device for visualizing a latent image on an image carrier by means of a developing agent, comprising:

means for storing the developing agent;

first supply means facing the image carrier, for supplying the developing agent to the latent image on the image carrier, the first supply means including a rotatable developing roller which has a volume resistivity ranging from $10^4$ to $10^8$ Ω·cm;

second supply means contacting the first supply means, for supplying the developing agent in the storing means to the first supply means, the second supply means including a rotatable supply roller in rolling contact with the developing roller and having a volume resistivity ranging from $10^4$ to $10^8$ Ω·cm; and means for applying different bias potentials individually to the first and second supply means so as to generate an electric field in which the developing agent is fed from the second supply means to the first supply means, the difference $|VS-VD|$ between the bias potential VS of the second supply means and the bias potential VD of the first supply means being set within the range of $0<|VS-VD|<200V$.

2. A device according to claim 1, wherein said applying means includes a first bias power source for applying the bias potential to the first supply means and a second bias power source for applying the bias potential to the second supply means.

3. A device according to claim 1, wherein said developing roller and said supply roller each have a volume resistivity ranging from $10^5$ to $10^7$ Ω·cm.

4. A device according to claim 1, wherein said developing roller and said supply roller each have a volume resistivity ranging from $10^4$ to $10^8$ Ω·cm, said developing agent transportation means includes a first protective resistor connected between the developing roller and the applying means and serving to adjust the volume resistivity of the developing roller, and said developing agent supply means includes a second protective resistor connected between the supply roller and the applying means and serving to adjust the volume resistivity of the supply roller.

5. A developing device for visualizing a latent image on an image carrier, comprising:

means for storing the developing agent;

a developing roller facing the image carrier, for supplying the developing agent to the latent image on the image carrier, the developing roller having a conductive shaft, and a surface layer which is formed around the conductive shaft and has a volume resistivity ranging from $10^4$ to $10^8$ Ω·cm;

a supply roller contacting the developing roller, for supplying the developing agent in the storing means to the developing roller, the supply roller having a conductive shaft, a surface layer being formed around the conductive shaft and having a volume resistivity ranging from $10^4$ to $10^8$ Ω·cm;

means for forming a thin layer of the developing agent, which is supplied from the supply roller, on an outer surface of the developing roller;

a first bias power source for applying a bias potential to the developing roller; and a second bias power source for applying a bias potential, different from the bias potential applied from the first bias power source, to the supply roller so as to generate an electric field in which the developing agent is fed from the supply roller toward the developing roller, the difference $|VS-VD|$ between the bias potential VS of the supply roller and the bias potential VD of the developing roller being set within the range of $0<|VS-VD|<200V$.

6. A device according to claim 5, wherein said surface layers of the developing roller and the supply roller each have a volume resistivity ranging from $10^5$ to $10^7$ Ω·cm.

7. A device according to claim 5, which further comprises a first protective resistor connected between the developing roller and the applying means so as to adjust the volume resistivity of the developing roller, and a second protective resistor connected between the supply roller and the applying means so as to adjust the volume resistivity of the supply roller.

8. The device of claim 5, in which the developing agent is of the one-component type.

* * * * *